US011604024B2

(12) United States Patent
Paradowski et al.

(10) Patent No.: US 11,604,024 B2
(45) Date of Patent: Mar. 14, 2023

(54) METHOD FOR PRODUCING PURE NITROGEN FROM A NATURAL GAS STREAM CONTAINING NITROGEN

(71) Applicant: L'Air Liquide, Société Anonyme pour l'Etude et l'Exploitation des Procédés Georges Claude, Paris (FR)

(72) Inventors: Henri Paradowski, Pluvigner (FR); Sébastien Lichtle, Paris (FR); Marie Muhr, Champigneulles (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 311 days.

(21) Appl. No.: 16/954,769

(22) PCT Filed: Dec. 17, 2018

(86) PCT No.: PCT/FR2018/053332
§ 371 (c)(1),
(2) Date: Jun. 17, 2020

(87) PCT Pub. No.: WO2019/122654
PCT Pub. Date: Jun. 27, 2019

(65) Prior Publication Data

US 2021/0088276 A1 Mar. 25, 2021

(30) Foreign Application Priority Data

Dec. 21, 2017 (FR) ..... 1762735

(51) Int. Cl.
*F25J 1/00* (2006.01)
*F25J 1/02* (2006.01)
*F25J 3/02* (2006.01)

(52) U.S. Cl.
CPC ..... *F25J 1/0022* (2013.01); *F25J 1/005* (2013.01); *F25J 1/0237* (2013.01); *F25J 3/0209* (2013.01);
(Continued)

(58) Field of Classification Search
CPC ..... F25J 1/0022; F25J 1/005; F25J 1/0237; F25J 3/0209; F25J 3/0233; F25J 3/0257;
(Continued)

(56) References Cited

U.S. PATENT DOCUMENTS 5,617,741 A 4/1997 McNeil et al.
6,105,389 A 8/2000 Paradowski et al.
(Continued)

FOREIGN PATENT DOCUMENTS

GB 2298034 A * 8/1996 ..... F25J 3/0209
RU 2010 132951 2/2012

OTHER PUBLICATIONS

International Search Report for corresponding PCT/FR2018/053332, dated Mar. 20, 2019.

*Primary Examiner* — Miguel A Diaz
*Assistant Examiner* — Ibrahim A. Michael Adeniji
(74) *Attorney, Agent, or Firm* — Elwood L. Haynes

(57) ABSTRACT

A process for liquefying a natural gas feed stream including cooling a feed gas stream to obtain a liquefied natural gas stream; introducing the liquefied natural gas stream into a deazotization column to produce a liquefied natural gas stream and a nitrogen-enriched vapor stream; at least partially condensing at least part of the nitrogen-enriched vapor stream to produce a two-phase stream; introducing the two-phase stream into a phase-separating vessel to produce a first liquid stream and a first nitrogen-enriched gas stream; introducing at least part of the nitrogen-enriched gas stream into a distillation column thereby producing a second nitro-
(Continued)

gen-enriched stream containing less than 1 mol % of methane and a second liquid stream containing less than 10 mol % of nitrogen; wherein at least part of the liquefied natural gas stream is used to cool the at least part of the nitrogen-enriched vapor stream in said heat exchanger.

12 Claims, 1 Drawing Sheet

(52) U.S. Cl.
CPC ..... *F25J 3/0233* (2013.01); *F25J 3/0257* (2013.01); *F25J 3/0295* (2013.01); *F25J 2200/02* (2013.01); *F25J 2200/74* (2013.01); *F25J 2205/02* (2013.01); *F25J 2210/04* (2013.01); *F25J 2215/04* (2013.01); *F25J 2230/32* (2013.01)

(58) Field of Classification Search
CPC .... F25J 3/0295; F25J 2200/02; F25J 2200/74; F25J 2205/02; F25J 2210/04; F25J 2215/04; F25J 2230/32; F25J 2200/76; F25J 2230/08; F25J 2245/02; F25J 2270/02; F25J 2270/08; F25J 2270/12; F25J 2270/66; F25J 2270/88; F25J 1/004; F25J 1/0045; F25J 1/0052; F25J 1/0219; F25J 1/0292; F25J 2220/62; F25J 2210/60; F25J 2230/42; F25J 2235/60
See application file for complete search history.

(56) References Cited

U.S. PATENT DOCUMENTS

| | | | | |
|---|---|---|---|---|
| 6,449,984 | B1 * | 9/2002 | Paradowski | F25J 1/0052 62/619 |
| 6,763,680 | B2 | 7/2004 | Fischer et al. | |
| 2004/0003625 | A1 * | 1/2004 | Fischer | F25J 3/061 62/612 |
| 2008/0173585 | A1 * | 7/2008 | White | F25J 3/0266 210/194 |
| 2011/0041551 | A1 | 2/2011 | Bauer et al. | |
| 2011/0239701 | A1 | 10/2011 | Kaart et al. | |
| 2012/0090355 | A1 | 4/2012 | Johnson et al. | |

* cited by examiner

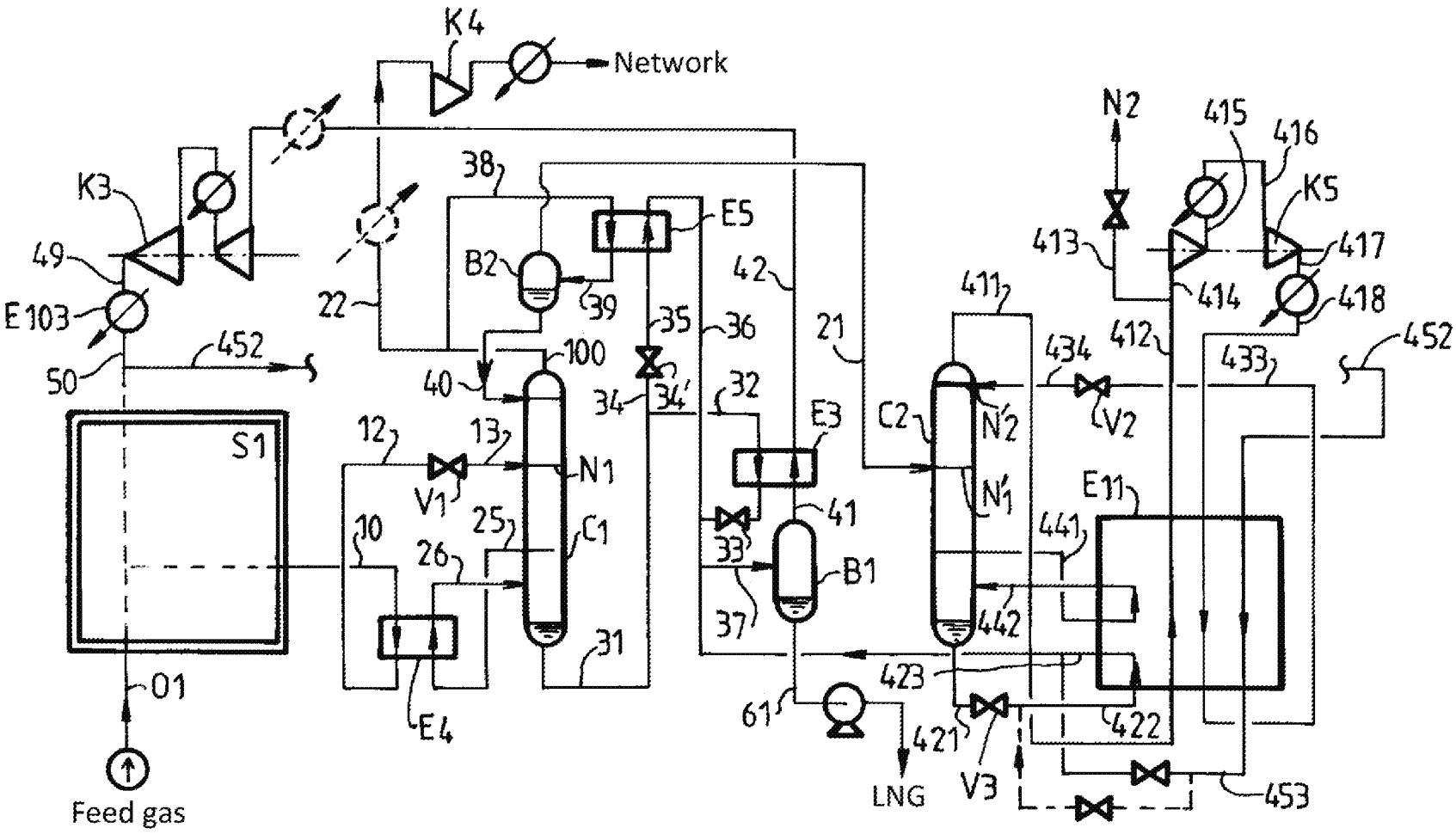
Network
Feed gas
LNG
N2
K3
K4
K5
E103
E11
E3
E4
E5
B1
B2
C1
C2
N1
S1
V1
V2
V3
452
453
01
10
12
13
21
22
25
26
31
32
33
34
35
36
37
38
39
40
41
42
49
50
61
100
411
412
413
414
415
416
417
418
421
422
423
433
434
441
442

METHOD FOR PRODUCING PURE NITROGEN FROM A NATURAL GAS STREAM CONTAINING NITROGEN

CROSS REFERENCE TO RELATED APPLICATIONS

This application is a 371 of International Application No. PCT/FR20181053332, filed Dec. 17, 2018, which claims priority to French Patent Application No. 1762735, filed Dec. 21, 2017, the entire contents of which are incorporated herein by reference.

BACKGROUND

The present invention relates to the field of liquefying natural gas. The liquefaction of natural gas consists in condensing natural gas and in subcooling it to a temperature that is low enough for it to be able to remain liquid at atmospheric pressure. It is then transported in methane tankers.

At the present time, the international market for liquid natural gas (LNG) is growing rapidly, but the whole LNG production chain requires substantial investments. Reducing the level of these investments per ton of LNG produced is thus a prime objective. It is also important to reduce the carbon footprint by reducing the fuel consumption.

U.S. Pat. No. 6,105,389 proposes a liquefaction process including two coolant mixtures circulating in two independent closed circuits. Each of the circuits functions by means of a compressor communicating to the coolant mixture the power required to cool the natural gas. Each compressor is driven by a gas turbine which is chosen from the standard ranges proposed on the market. However, the power of the gas turbines that are currently available is limited.

U.S. Pat. No. 6,763,680 describes a liquefaction process in which the liquefied natural gas under pressure is expanded in at least two steps so as to obtain at least two gas fractions. The liquefied natural gas under pressure is cooled while ensuring the reboiling of a denitrogenation column, At the column outlet, a first nitrogen-depleted liquid fraction and a first nitrogen-enriched gas fraction are obtained. This liquid fraction is again expanded to give a nitrogen-depleted liquefied natural gas and a second gas fraction. At least one gas fraction is recompressed and then mixed with the natural gas before condensation.

Moreover, a process for liquefying natural gas as described in the prior art is unsuitable when said natural gas to be liquefied comprises an excessive content of nitrogen.

Furthermore, it is not always desirable to use gas which has too high a concentration of nitrogen for the network, in particular to permit good functioning of the gas turbines.

One of the objects of the present invention is to enable a reduction in the investment cost required for a liquefaction plant. Another object of the present invention is to achieve, under better conditions, separation of the nitrogen which may be contained in the gas and to expel some of the nitrogen contained in the natural gas into the atmosphere in the form of pure nitrogen. The term "pure nitrogen" refers to nitrogen containing between 50 ppm and 1% of methane, according to the legislation in force.

Thus, the inventors of the present invention have developed a solution for producing nitrogen-depleted liquefied natural gas from a natural gas feed stream which may contain more than 4 mol % of nitrogen, while at the same time saving energy and minimizing the costs required for the deployment of processes of this type.

SUMMARY

One subject of the present invention is a process for liquefying a natural gas feed stream, comprising the following steps:

Step a): cooling the feed gas stream to obtain a liquefied natural gas stream at a temperature T1 and a pressure P1*b;*

Step b): introducing the stream obtained from step a) into a denitrogenation column at a pressure P2 and a temperature T2 below T1 to produce, in the vessel of said column, a denitrogenated liquefied natural gas stream, and, at the top of said column, a nitrogen-enriched vapor stream;

Step c): at least partially condensing at least part of the nitrogen-enriched vapor stream obtained from step b) in a heat exchanger to produce a two-phase stream;

Step d): introducing the two-phase stream obtained from step c) into a phase-separating vessel to produce at least two phases including a liquid stream and a nitrogen-enriched gas stream;

Step e): introducing the gas stream obtained from step d) into a distillation column at the pressure P2 producing, at the top, a nitrogen-enriched stream containing less than 1 mol % of methane and, in the vessel, a liquid stream containing less than 10 mol % of nitrogen;

characterized in that at least part of the liquid stream obtained from step b) is used in step c) to cool said at least part of the nitrogen-enriched vapor stream obtained from step b) in said heat exchanger.

According to other embodiments, a subject of the invention is also:

- A process as defined above, characterized in that, during step a), said natural gas feed stream and a second coolant mixture are cooled by indirect heat exchange with at least one first coolant mixture to obtain a cooled natural gas and a second cooled coolant mixture, and the cooled natural gas is then condensed and cooled by indirect heat exchange with the second cooled coolant mixture and with at least some of the gas stream obtained in step d) to obtain a liquefied natural gas.
- A process as defined above, characterized in that the nitrogen-enriched stream produced in step e) contains less than 100 molar ppm of methane and the liquid stream produced in step e) contains less than 4 mol % of nitrogen.
- A process as defined above, characterized in that, prior to step b), the stream obtained from step a) is cooled in a reboiling means of said denitrogenation column down to the temperature T2.
- A process as defined above, characterized in that the stream cooled to the temperature T2 is expanded in an expansion means before being introduced into the denitrogenation column.
- A process as defined above, characterized in that at least part of the liquid stream obtained from step d) is used as reflux at the top of the denitrogenation column.
- A process as defined above, characterized in that it comprises the following steps:

Step f): the part of the liquid stream obtained from step b) which is not used in step c) is cooled by indirect heat exchange with a second gas fraction obtained in step g) to obtain a cooled liquid fraction and a second heated gas fraction;

Step g): the cooled liquid fraction obtained in step f) is expanded and is then introduced into a second phase-separating vessel (B1), to obtain a liquefied natural gas and the second gas fraction;

Step h): at least part of the second heated gas fraction obtained in step g) is compressed to a pressure P1.

Step i): at least part of the liquid stream obtained from step e) is cooled by indirect heat exchange;

Step j): the stream obtained from step i) is mixed with the expanded mixture obtained in step g) before introduction into said second phase-separating vessel (B1).

A process as defined above, characterized in that the nitrogen content of the nitrogen-enriched gas stream obtained from step e) is greater than 50 mol %.

A process as defined above, characterized in that T1 is between −140° C. and −120° C.

A process as defined above, characterized in that P2 is between 3 bar abs and 10 bar abs, A process as defined above, in which, in step a), the natural gas mixture and the second coolant mixture are cooled to a temperature of between −70° C. and −35° C. by heat exchange with the first coolant mixture.

A process as defined above, in which the first coolant mixture includes, as a mole fraction, the following components:

Ethane: 30% to 70%

Propane: 30% to 70%

Butane: 0% to 20%.

A process as defined above, in which the second coolant mixture includes, as a mole fraction, the following components:

Nitrogen: 0% to 20%

Methane: 30% to 70%

Ethane: 30% to 70%

Propane: 0% to 10%.

The process according to the invention effectively makes it possible to substantially increase the production capacity while adding a limited number of additional items of equipment.

The process according to the invention is particularly advantageous when each of the cooling circuits uses a coolant mixture which is entirely condensed, expanded and vaporized.

The term "feed stream" as used in the present patent application relates to any composition containing hydrocarbons, including at least methane.

The heat exchanger may be any heat exchanger, any unit or other arrangement suitable for allowing the passage of a certain number of streams, and thus allowing direct or indirect heat exchange between one or more coolant fluid lines and one or more feed streams.

BRIEF DESCRIPTION OF THE DRAWING

For a further understanding of the nature and objects for the present invention, reference should be made to the following detailed description, taken in conjunction with the accompanying drawings, in which like elements are given the same or analogous reference numbers and wherein:

FIG. 1 schematically illustrates a liquefaction process according to the invention.

DETAILED DESCRIPTION OF PREFERRED EMBODIMENTS

In FIG. 1, a natural gas feed stream 1 is introduced into a heat exchanger unit S1 at a temperature T1.

This unit S1 may comprise one or more heat exchangers E1, E2 and one or more coolant compressors K1, K2.

Typically, the feed stream 1 may contain methane, ethane, propane, hydrocarbons containing at least four carbon atoms. This stream may contain traces of contaminants, for example from 0 to 1 ppm of $H_2O$, 4 ppm of $H_2S$, 50 ppm of $CO_2$, etc. The molar percentage of nitrogen in this feed stream may be greater than 4%.

According to the natural gas liquefaction process represented schematically by FIG. 1, the natural gas stream 1 is introduced at a pressure P1 of between 4 MPa and 7 MPa and at a temperature of between 0° C. and 60° C. into the unit S1. The main natural gas stream 1 is mixed with the gas 50 to form a natural gas mixture circulating in the unit S1. The mixture thus formed leaves liquefied from the unit S1 via pipe 10 at a temperature preferably at least 10° C. higher than the bubble temperature of the liquefied natural gas produced at atmospheric pressure (the bubble temperature denotes the temperature at which the first vapor bubbles form in a liquid natural gas at a given pressure) and at a pressure P1*b* identical to the inlet pressure P1 of the natural gas, pressure losses aside.

For example, the natural gas leaves the unit S1 at a temperature of between −105° C. and −145° C. and at a pressure of between 4 MPa and 7 MPa. Under these temperature and pressure conditions, the natural gas does not remain entirely liquid after expansion up to atmospheric pressure.

The natural gas circulating in pipe 10 is cooled in the reboiler E4 of a denitrogenation column C1.

The natural gas 12 is cooled by heating the bottom (25, 26) of the column C1 by indirect heat exchange, and is then expanded in the expansion member V1. The two-phase mixture 13 obtained at the outlet of the member V1 is introduced into the column C1 at a level N1. A nitrogen-enriched gas fraction 100 is recovered at the top of the column C1. The gas fraction 100 is separated into two parts 38 and 22. One part 22 is heated, compressed by means of the compressor K4 and sent to the network, which can serve as fuel gas, a source of energy for the functioning of a liquefaction plant.

The other part 38 is sent to be cooled 39 in a heat exchanger E5 and then separated in a phase-separating vessel B2 in the form of a gas fraction 21 and a liquid fraction 40. The liquid fraction 40 evacuated from the vessel B2 is used as reflux at the top of the column C1.

The nitrogen-depleted liquid fraction 31 evacuated from the vessel of the column C1 is separated into two parts 32 and 34, A first part 32 is cooled in a heat exchanger E3 and is then expanded in an expansion member 33' to a pressure of between 0.05 MPa and 0.5 MPa. The second part 34 of the liquid fraction 31 is expanded 35 in an expansion member 34' and then feeds a heat exchanger E5. Vaporization of this stream 35 gives a stream 36 and represents the majority of the cooling necessary for cooling the gas stream 38 obtained from the top of the column C1 in the heat exchanger E5.

The expansion members such as V1, 33' and 34' may be an expansion turbine, an expansion valve or a combination of a turbine and a valve. The two-phase mixture obtained at the outlet of the expansion member 33 is separated in a phase-separating vessel B1 in the form of a gas fraction 41 and a liquid fraction 61. The gas fraction 41 is introduced into the exchanger E3. In the exchanger E3, the gas fraction 41 cools the liquid fraction 32 obtained from the liquid stream 31 recovered in the vessel of the column C1 and is then directed via pipe 42 to the compressor K3. The gas mixture 49 leaving the compressor K3 is sent to a heat exchanger E103 to be cooled by air or water. The gas mixture 50 leaving the exchanger E103 is then mixed with the natural gas stream 1 circulating in the unit S1.

The liquid fraction 61 evacuated from the tank B1 forms the liquefied natural gas (LNG) produced.

More particularly, the denitrogenated LNG stream 31 produced at the bottom of the column C0 is divided into two parts:

- a first minor part, stream 34, is expanded in the valve 34' to a low pressure P3 of between 0.05 MPa and 0.5 MPa to give the stream 35 and feeds the exchanger E5. Vaporization of this stream which gives the stream 36 provides the majority of the cooling necessary for cooling the head vapor in the exchanger E5.
- A second major part, stream 32, is cooled counter-currentwise relative to the flash gas, stream 41, to give the stream 33 which is expanded to a pressure P3 to be mixed with the stream 36 and to give the stream 37 which feeds the LNG flash tank B1.

The gas fraction 21 evacuated from the vessel B2 is introduced, at the pressure P2, into a distillation column C2 producing, at the top, pure nitrogen 411 and, at the bottom, a liquid 421 with a low nitrogen content, i.e. containing less than 10 mol % of nitrogen, preferably less than 4%.

The head gas, stream 411, of this column C2 consisting of pure nitrogen, for example containing less than 1 mol % of methane, preferably less than 100 molar ppm of methane, is heated in the heat exchanger E11 up to a temperature close to room temperature.

A portion, stream 414, is compressed up to a high pressure P4 in the multi-stage compressor K5 to form, after cooling to room temperature, the stream 418. P4 is typically greater than 15 bar abs. P2 is, for example, between 3 bar abs and 10 bar abs.

The stream 418 is then expanded, for example in the valve V2 (or in a hydraulic turbine) and feeds the column C2 on the head plateau. It constitutes a reflux.

A very minor part of the stream 1 is withdrawn to give the stream 452 which is cooled in the exchanger E11. This stream 452 makes it possible to conserve, in the exchanger E11, temperature conditions that are compatible with the use of a plate exchanger. On starting up the facility, additional cooling is provided by expansion of a part of this stream 452.

The stream 421 is expanded by means of a valve V3. The expanded stream 422 is introduced into the exchanger E11 counter-currentwise relative to the stream 418 and is then evacuated 423 and finally mixed with the stream 37 which is introduced into the tank B1.

The process according to the present invention thus makes it possible to produce a nitrogen-depleted liquefied natural gas while saving in energy, starting with a natural gas stream containing a much larger amount of nitrogen than that which is permitted by the specifications.

In addition, the process according to the invention makes it possible to produce fuel gas whose nitrogen content is compatible with the specifications for various items of equipment and for pure nitrogen. The term "pure nitrogen" refers to nitrogen containing between 50 molar ppm and 1 mol % of methane, according to the legislation in force.

In order to further illustrate the implementation of a process as represented schematically in FIG. 1 and as described previously, the data for the implementation of said process according to the invention are illustrated by the following numerical example.

These data have been collated in the following table.

The natural gas arrives via line 01 at a pressure of 60 bar and a temperature of 15° C. The composition of this gas, in mole fractions, is as follows:

Methane: 90%

Ethane: 2.5%

Propane: 1%

Isobutane: 3.3% n-Butane: 0.2%

Nitrogen: 6%.

The coolant mixture of the pre-cooling cycle (PR) is composed of 50% ethane and 50% propane, the flow rates are adapted as need be.

| | | Stream | Process of the invention |
|---|---|---|---|
| Feed natural gas | kg/h | 01 | 271000 |
| LNG produced | kg/h | 61 | 239640 |
| Nitrogen content of the LNG | mol % | 61 | 1 |
| Nitrogen content of stream 28 | mol % | | 43.6 |
| Column C1 pressure | Bar abs | | 4.95 |
| Flash gas recycle | kg/h | 41 | 48700 |
| Compressor K1 power | kW | | 22300 |
| Compressor K2 power | kW | | 31600 |
| Compressor K3 power | kW | | 5300 |
| Compressor K5 power | kW | | 900 |
| Total compressor power | kW | | 60100 |
| LNG temperature at E2 outlet | ° C. | 10 | −135 |
| NG temperature at E1 outlet | ° C. | 04 | −58 |
| Nitrogen in LR | Nm3/h | 100 | 2000 |
| Methane in LR | Nm3/h | 100 | 108000 |
| Ethane in LR | Nm3/h | 100 | 143000 |
| Propane in LR | Nm3/h | 100 | 26500 |
| Total LR | Nm3/h | 100 | 279500 |
| PR total | Nm3/h | 201 | 420000 |
| Low pressure PR | Nm3/h | 223 | 107500 |
| Medium pressure PR | Nm3/h | 217 | 121000 |
| High pressure PR | Nm3/h | 207 | 191500 |
| Low pressure LR pressure | Bar abs | 102 | 2.4 |
| High pressure LR pressure | Bar abs | 108 | 36.4 |
| Tank B1 pressure | Bar abs | | 1.6 |
| Column C2 pressure | Bar abs | | 4.6 |
| Nitrogen produced | kg/h | 413 | 9150 |
| Pressure of nitrogen produced | Bar abs | 413 | 4.5 |
| Nitrogen content of stream 421 | % | 421 | 4.2 |
| Methane content of the nitrogen | ppm | 413 | 85 |

The stream 22 sent to the gas network is intended to feed the turbines. The nitrogen content of the gas on the network must be compatible with the functioning of the gas turbines. The stream 22 in the above numerical example contains 44 mol % of nitrogen. The process according to the invention has the advantage of affording great flexibility regarding the choice of the flow rate of the stream 22 so as to obtain the desired nitrogen content on the network by mixing with feed gas or other sources of gases intended for the network.

It will be understood that many additional changes in the details, materials, steps and arrangement of parts, which have been herein described in order to explain the nature of the invention, may be made by those skilled in the art within the principle and scope of the invention as expressed in the appended claims, Thus, the present invention is not intended to be limited to the specific embodiments in the examples given above.

The invention claimed is:

1. A process for liquefying a natural gas feed stream, comprising:

cooling a feed gas stream to obtain a liquefied natural gas stream at a temperature T1 and a pressure P1*b;* introducing the liquefied natural gas stream into a denitrogenation column at a pressure P2 and a temperature T2 below the temperature T1 to produce a denitrogenated liquefied natural gas stream and a nitrogen-enriched vapor stream;

at least partially condensing at least part of the nitrogen-enriched vapor stream in a heat exchanger to produce a two-phase stream;

introducing the two-phase stream into a phase-separating vessel to produce at least two phases including a first liquid stream and a first nitrogen-enriched gas stream;

introducing at least part of the nitrogen-enriched gas stream into a distillation column at the pressure P2 thereby producing a second nitrogen-enriched stream containing less than 1 mol % of methane and a second liquid stream containing less than 10 mol % of nitrogen;

cooling the part of the liquefied natural gas stream which is not partially condensed, by indirect heat exchange with a second gas fraction to obtain a cooled liquid fraction and a second heated gas fraction;

expanding the cooled liquid fraction and introducing the expanded cooled liquid gas fraction into a second phase-separating vessel, to obtain a liquefied natural gas and the second gas fraction;

compressing at least part of the second heated gas fraction to a pressure P1, cooling at least part of the second liquid stream by indirect heat exchange, thereby producing a cooled second liquid stream;

mixing the cooled second liquid stream with the expanded cooled liquid fraction before introduction into the second phase-separating vessel, wherein at least part of the liquefied natural gas stream is used to cool the at least part of the nitrogen-enriched vapor stream in said heat exchanger.

2. The process of claim 1, wherein the natural gas feed stream and a second coolant mixture are cooled by indirect heat exchange with at least one first coolant mixture to obtain a cooled natural gas and a second cooled coolant mixture, and the cooled natural gas is then condensed and cooled by indirect heat exchange with at least the second cooled coolant mixture to obtain a liquefied natural gas.

3. The process of claim 1, wherein the second nitrogen-enriched stream contains less than 100 molar ppm of methane and the second liquid stream contains less than 4 mol % of nitrogen.

4. The process of claim 1, wherein the liquefied natural gas stream is cooled in a reboiling means of said denitrogenation column down to the temperature T2.

5. The process of claim 1, wherein the liquefied natural gas stream cooled to the temperature T2 is expanded in an expansion means before being introduced into the denitrogenation column.

6. The process of claim 1, wherein at least part of the first liquid stream is used as reflux at the top of the denitrogenation column.

7. The process of claim 3, wherein the nitrogen content of the second nitrogen-enriched gas stream is greater than 50 mol %.

8. The process of claim 3, wherein T1 is between −140° C. and −120° C.

9. The process of claim 3, wherein P2 is between 3 bar abs and 10 bar abs.

10. The process of claim 2, wherein a natural gas mixture and the second coolant mixture are cooled to a temperature of between −70° C. and −35° C. by heat exchange with the first coolant mixture.

11. The process of claim 2, wherein the first coolant mixture comprises, as a mole fraction, the following components:

Ethane: 30% to 70%
Propane: 30% to 70%
Butane: 0% to 20%.

12. The process of claim 2, wherein the second coolant mixture comprises, as a mole fraction, the following components:

Nitrogen: 0% to 20%
Methane: 30% to 70%
Ethane: 30% to 70%
Propane: 0% to 10%.

* * * * *